United States Patent [19]

Thuries et al.

[11] Patent Number: 4,945,197

[45] Date of Patent: Jul. 31, 1990

[54] HIGH TENSION CIRCUIT BREAKER INCLUDING A DIELECTRIC GAS USED FOR BLASTING

[75] Inventors: Edmond Thuries, Pusignan; Denis Dufournet, Bron; Michel Perret, Tramole, all of France

[73] Assignee: Societe Anonyme dite: GEC Alsthom SA, Paris, France

[21] Appl. No.: 405,155

[22] Filed: Sep. 11, 1989

[30] Foreign Application Priority Data

Sep. 16, 1988 [FR] France ..... 88 12115

[51] Int. Cl.[5] ..... H01H 33/88

[52] U.S. Cl. ..... 200/148 A; 200/148 R

[58] Field of Search ..... 200/148 A, 148 R

[56] References Cited

U.S. PATENT DOCUMENTS 4,880,946 11/1989 Thuries et al. ..... 200/148 R

FOREIGN PATENT DOCUMENTS 2349263 4/1975 Fed. Rep. of Germany .
3141324 5/1983 Fed. Rep. of Germany .
2610763 8/1988 France .

*Primary Examiner*—Robert S. Macon
*Attorney, Agent, or Firm*—Sughrue, Mion, Zinn, Macpeak & Seas

[57] ABSTRACT

The present invention provides a circuit breaker in which the blast cylinder is delimited by a first cylinder (5) constituting the moving arcing contact, a second cylinder (7) constituting the fixed main contact, and a first piston (14) sliding between said first and second cylinders, said first piston being urged by a spring (17) to come into abutment against a part (16A) fixed to the fixed assembly, the cylinder (5) constituting the moving arcing contact and a tube (16) connected to the fixed assembly and coaxial with said cylinder together delimiting, on the other side of the piston (14) closing the blast cylinder, a variable volume (35, 35B) closed at one end by said first piston (14) and at its other end by an annular end piston (42) connected to said first cylinder (5) and sliding along said tube (16), said volume enclosing said secondary contacts, a first secondary contact (30) being fixed to said tube (16) and the second secondary contact (31) being entrained by said first cylinder (5).

7 Claims, 2 Drawing Sheets

HIGH TENSION CIRCUIT BREAKER INCLUDING A DIELECTRIC GAS USED FOR BLASTING

The present invention relates to a high tension circuit breaker in which the circuit-breaking chamber is filled with dielectric gas, such as sulfur hexafluoride, and in which the energy of the arc is used, by virtue of the pressure increase it imparts to the gas, for the purpose of reducing the drive energy required for circuit breaking.

The invention relates more particularly to a circuit breaker having a blast cylinder and a second chamber containing a pair of additional contacts capable, during circuit breaking, of generating a secondary arc which is used to contribute energy to the circuit breaking operation.

BACKGROUND OF THE INVENTION

One such circuit breaker is described, for example, in French Pat. No. 8701545 (published under No. 2 610 763).

A problem to be solved in this type of circuit breaker is that the pressure should remain low in the blast cylinder when interrupting low currents (low drive energy), and that the pressure should be high for interrupting high currents, but without requiring a corresponding increase in drive energy.

An object of the present invention is to provide a circuit breaker in which the drive energy remains low even when interrupting low currents. Another object of the invention is to provide a circuit breaker in which the blast pressure is greatly increased when interrupting short circuit currents.

SUMMARY OF THE INVENTION

The present invention provides a high tension circuit breaker having a dielectric gas under pressure, the circuit breaker being of the type including at least one circuit breaking chamber comprising an insulating envelope filled with said gas and containing a fixed assembly comprising a fixed main contact and a fixed arcing contact, and a moving assembly comprising in particular a moving main contact and a moving arcing contact, the circuit-breaking chamber further including a pair of secondary contacts and a blast cylinder opening out into a blast nozzle, wherein said blast cylinder is delimited The cylinder 5 is driven by a metal tube 6, e.g. made of aluminum, which is fixed to a drive rod (not shown). The tubes 5 and 6 are not fixed to each other. On the contrary, a degree of lost motion is provided between them. Drive takes place via two steps 5B and 6B on the tubes 5 and 6. The extent of the lost motion is limited by an abutment 6C.

A metal tube 7 disposed concentrically about the cylinder serves as the moving main contact.

It carries a blast nozzle 8 made of insulating material. It is in electrical contact via contact fingers 10 with a metal block 9 made of aluminum for example and fixed to the fixed equipment.

The cylinder 5 and the tube 7 are interconnected via an insulating ring 12 which is pierced by holes 12A.

The volume 20 delimited between the tubes 5 and 7 is closed by a piston 14 made of an insulating material, e.g. polytetrafluoroethylene.

The piston 14 is made to be semi-moving relative to the fixed equipment. To this end, the piston 14 is fixed to a portion of a cylinder 15 which is terminated by a step

15A and which is suitable for sliding along the inside wall of the cylinder 7.

The stroke of the cylinder is limited by coming into abutment with a step-forming tip 16A of a cylinder 16 which is fixed to the block 9.

A spring 17 is placed between the steps 15A and 16A and urges the piston 14 to bear against the abutment 16A.

The piston 14 optionally includes a non-return valve 15A to allow gas to flow in an outward direction only from the volume 20. The piston 14 includes a sealing ring 18 and a guide ring 19.

A pair of auxiliary contacts comprises:

a fixed tubular contact 30 fixed to the tube 16 and provided with a tip 30A made of arc-withstanding material; and a tubular contact 31 fixed to a guide block 32 made of insulating material, provided with a wear tip 31A, and provided with sliding contacts 31B which co-operate with the tube 5. by a first cylinder constituting the moving arcing contact, a second cylinder constituting the fixed main contact, and a first piston sliding between said first and second cylinders, said first piston being urged by a spring to come into abutment against a part fixed to the fixed assembly, the cylinder constituting the moving arcing contact and a tube connected to the fixed assembly and coaxial with said cylinder together delimiting, on the other side of the piston closing the blast cylinder, a variable volume closed at one end by said first piston and at its other end by an annular end piston connected to said first cylinder and sliding along said tube, said volume enclosing said secondary contacts, a first secondary contact being fixed to said tube and the second contact being entrained by said first cylinder.

BRIEF DESCRIPTION OF THE DRAWINGS

An embodiment of the invention is described by way of example with reference to the accompanying drawings, in which.

DETAILED DESCRIPTION

Figure 1:
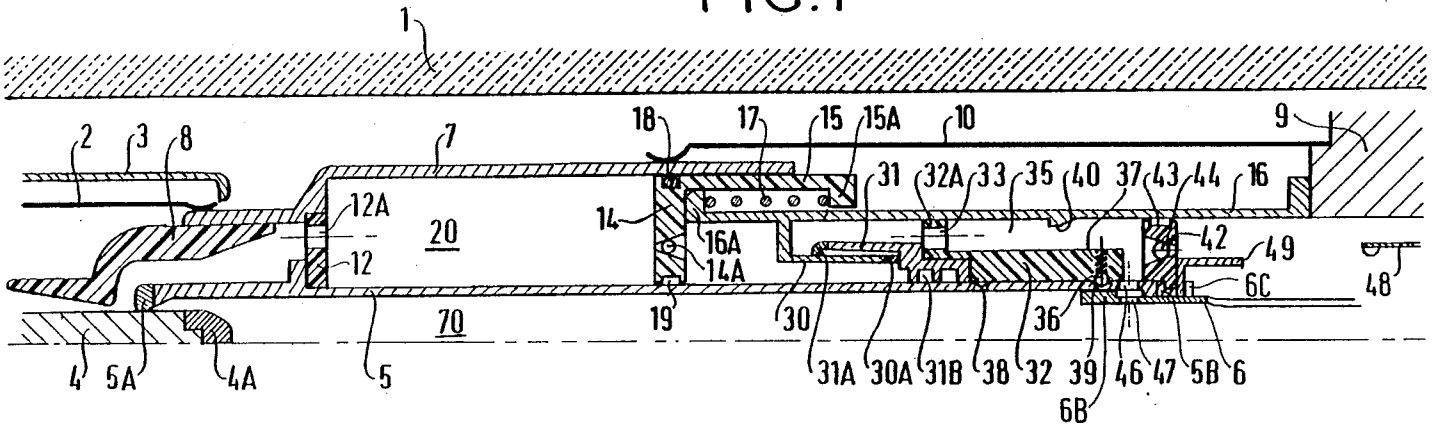
FIG. 1 is a fragmentary axial half-section through the circuit-breaking chamber of a circuit breaker of the invention, shown in the current-passing position.

FIG. 1 shows a circuit-breaking chamber comprising an envelope 1 made of an insulating material such as a ceramic and filled with a dielectric gas such as sulfur hexafluoride at a pressure of a few bars. Inside the envelope, there is an assembly including a fixed main contact constituted by contact fingers 2 protected by an anti-corona cap 3, and an arcing contact constituted by a metal tube 4 terminated by a tip 4A made of an alloy with withstands the effects of arcing.

The moving equipment includes a metal cylinder or tube 5 acting as the moving arcing contact and terminated by a tip 5A made of an alloy which withstands the effects of arcing.

The insulating block is guided inside the annular tubes 5 and 16 by means of a portion 32A which bears against the tube 16.

This portion is provided with orifices 33 in order to allow gas to pass freely into the annular space 35 between the tube 16 and the parts 31 and 32.

The insulating part 32 is provided with a snap engagement system, e.g. constituted by balls 36 and springs 37 co-operating with grooves 38 and 39 formed in the tube 5. An abutment 40 of the tube 16 limits the strokes of the parts 31 and 32.

The annular space 35 is closed by an insulating piston 42 which is fixed to the tube 5 and which possesses a guidance segment 43 and a non-return valve 44 allowing gas to flow inwards only into the volume 35.

The end of the tube 5 has holes 46. Similarly the tube 6 has holes 47.

The part 9 carries a contact 48 co-operating with one end 49 of the tube 5 in order to put the tube 5 at the same potential as the remainder of the moving equipment at the end of the circuit-breaking stroke.

The circuit breaker operates as follows:

When the circuit breaker is closed (position shown in FIG. 1), current flows via the fingers 2, the tube 7, the fingers 10, and the part 9.

INTERRUPTING LOW CURRENTS

Figure 2:
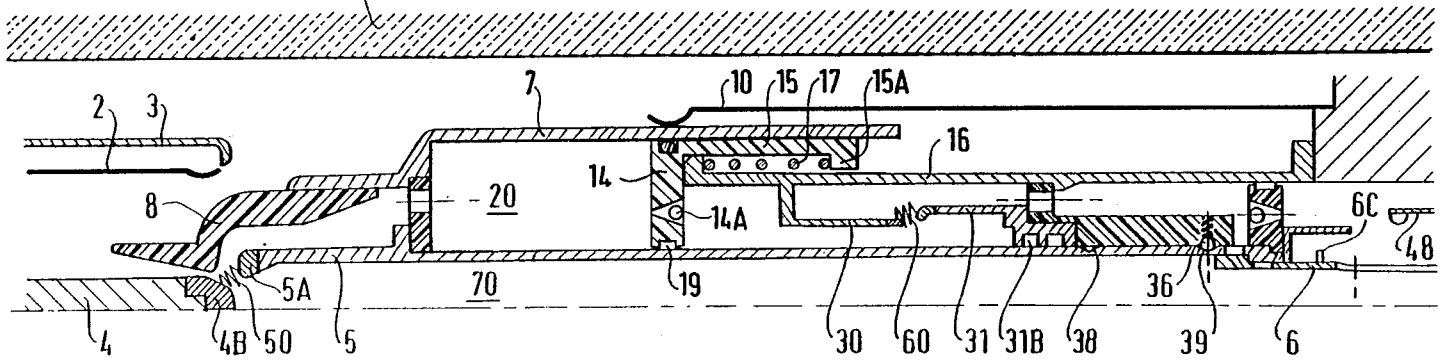
FIG. 2 is a similar view shown during the operation of interrupting a low current.

Low currents are currents less than or substantially equal to the nominal current of the installation. When the circuit breaker opens (FIG. 2), its moving equipment is driven by the tube 6. When the arcing contacts 4B and 5A separate, an arc 50 is struck therebetween. Together with the action of the spring 17, the increase in pressure in the chamber 20 maintains the piston 14 in abutment against the part 16. The pressure inside the chamber 20 remains constant and low, with any excess pressure escaping by opening the non-return valve 14A.

The suction set up in the volume 35 opens the non-return valve 44 and maintains pressure in the volume 35. Pneumatic energy is thus not lost by suction.

The arc 60 which is struck between the contacts 30 and 31 either simultaneously with the arc 50, or slightly earlier, or else slightly later, gives rise to an increase in pressure which is sufficiently low to avoid displacing the piston 14 relative to the abutment 16A.

Prior to the current being interrupted by the effect of the contacts moving apart, current flows via the contact 4, the arc 50, the tube 5, the contacts 31B, the contact 31, the arc 60, the contact 30, the tube 16, and the part 9.

Figure 3:
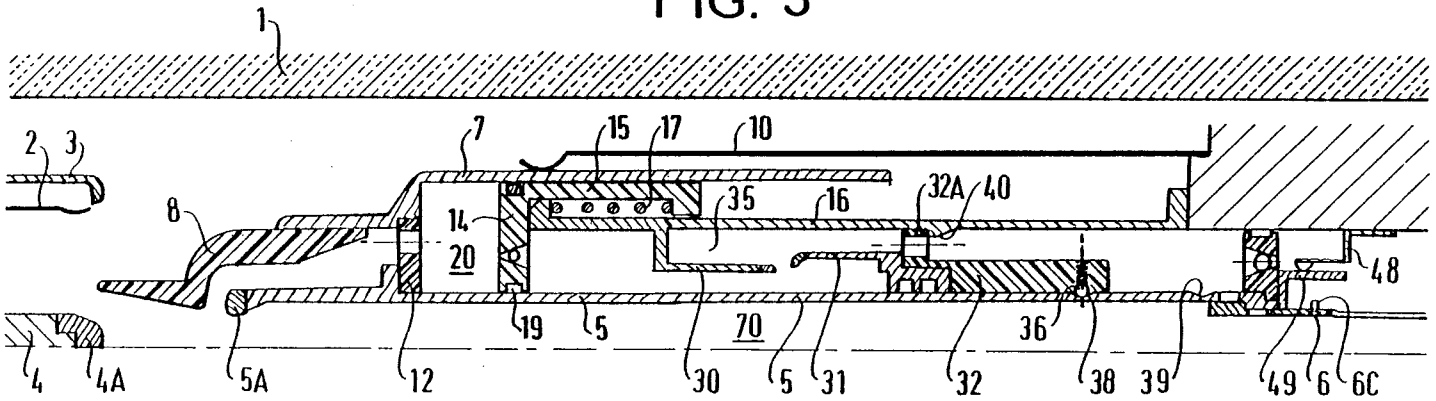
FIG. 3 is a similar view showing the end of the circuit-breaking operation.

After moving a certain distance, the part 32A comes into abutment with the abutment 40. As the tube 5 continues its stroke, the balls 36 escape from the groove 39 and engage in the groove 38 (FIG. 3) at the end of the opening operation.

The contact 48 puts the end 49 of the tube 5, and thus the contact 31, at the same potential as the part 9, the tube 16, and thus the contact 30.

Closing the Circuit Breaker

The tube 6 is driven towards the left of the figure. The abutment 6C entrains the tube 5 and the contacts 30 and 31 make contact without striking an arc since they are at the same potential by virtue of the contact between the parts 48 and 49. The slight pressure increase inside the volume 35 escapes into the volume 70 inside the tube 5 via the holes 46 and 47 when they come into coincidence. When the contact 30A comes into abutment against the block carrying the contact 31, the balls 36 leaves the groove 38 and move back into the groove 39 at the end of the closure operation.

At the end of the closure operation, the circuit breaker is back in the configuration shown in FIG. 1.

Interrupting High Currents

High currents are short circuit currents.

Figure 4:
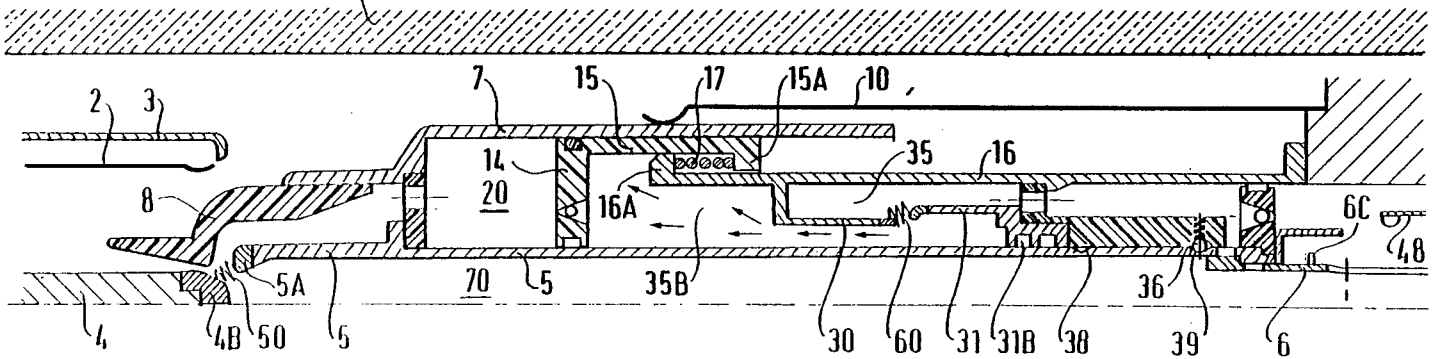
FIG. 4 is a similar view shown during the operation of interrupting a high current.

FIG. 4 shows the circuit breaker in the process of opening by the tube 6 being displaced towards the right in the figure.

The very high intensity arc 60 rapidly heats up the volume 35 and the volume 35B surrounded by the contacts 30 and 31, the piston 22, and the cylinder 5.

This causes the pressure inside the volumes 35 and 35B to increase very quickly, thereby moving the piston 14 against the effect of the spring 17.

The volume 20 is then compressed not only by the displacement of the piston due to the motion of the moving equipment of the circuit-breaking chamber, but also by the displacement of the piston 14 relative to the moving equipment.

The pressure increase inside the volume 35 closes the non-return valves 14A and 44.

Subjected to two sources of compression in this way, the gas in the chamber 20 produces an extremely energetic blast as it escapes via the nozzle 8.

A second effect of the increase of pressure in the volumes 35 and 35B is to exert a force on the insulating piston 42 and thereby make a contribution to the operating energy.

To do this, the hot gas in the volume 35 passes through the orifices 33 in the part 32A.

After interrupting a high current in this way, the circuit breaker is reclosed in the same manner as described above under the heading "closing the circuit breaker". The holes 46 and 47 serve to evacuate the excess pressure inside the volume 35 into the volume 70 when they overlie one another.

The circuit breaker of the invention requires low drive energy for all values of current to be interrupted. For short circuit currents the blast action is extremely energetic.

We claim:

1. A high tension circuit breaker having a dielectric gas under pressure, the circuit breaker being of the type including at least one circuit breaking chamber comprising an insulating envelope filled with said gas and containing a fixed assembly comprising a fixed main contact and a fixed arcing contact, and a moving assembly comprising in particular a moving main contact and a moving arcing contact, the circuit-breaking chamber further including a pair of secondary contacts and a blast cylinder opening out into a blast nozzle, wherein said blast cylinder is deliminted by a first cylinder constituting the moving arcing contact, a second cylinder constituting the fixed main contact, and a first piston sliding between said first and second cylinders, said first piston being urged by a spring to come into abutment against a part fixed to the fixed assembly, the cylinder constituting the moving arcing contact and a tube connected to the fixed assembly and coaxial with said cylinder together delimiting, on the other side of the piston closing the blast cylinder, a variable volume closed at one end by said first piston and at its other end by an annular end piston connected to said first cylinder and sliding along said tube, said volume enclosing said secondary contacts, a first secondary contact being fixed to said tube and the second secondary contact being entrained by said first cylinder.

2. A circuit breaker according to claim 1, wherein the second secondary contact is constrained to move between first and second fixed positions along the tube constituting the moving arcing contact.

3. A circuit breaker according to claim 2, wherein the second secondary contact is provided with snap engagement means co-operating with grooves formed in the tube constituting the moving arcing contact in order to hold said second secondary contact in said fixed positions.

4. A circuit breaker according to claim 1, wherein the fixed assembly carries a contact making contact with the tube constituting the moving arcing contact when the circuit breaker is opened.

5. A circuit breaker according to claim 1, wherein the piston closing the blast cylinder includes a non-return valve allowing gas to flow outwards only from said cylinder.

6. A circuit breaker according to claim 1, wherein said annular end piston includes a non-return valve allowing gas to flow inwards only into the volume containing the secondary contacts.

7. A circuit breaker according to claim 1, wherein the first cylinder constituting the moving arcing contact is connected to a drive tube with a degree of lost motion so as to enable holes formed through said cylinder constituting the moving arcing contact to be put into coincidence, when the circuit breaker is reclosed, with holes through said drive tube in order to evacuate the excess pressure inside the volume containing the secondary contacts.

* * * * *